United States Patent [19]

Alexander

[11] Patent Number: 4,961,494

[45] Date of Patent: Oct. 9, 1990

[54] STAND ON END TRAY CONTAINER

[75] Inventor: Garold W. Alexander, Powell, Ohio

[73] Assignee: Pressware International, Inc., Columbus, Ohio

[21] Appl. No.: 434,268

[22] Filed: Nov. 13, 1989

[51] Int. Cl.[5] ..... B65D 5/52

[52] U.S. Cl. ..... 206/45.2; 206/45.24

[58] Field of Search ..... 206/45.2, 45.21, 45.23, 206/45.24, 45.25

[56] References Cited

U.S. PATENT DOCUMENTS 1,732,436 10/1929 Floto .
2,005,816 6/1935 Weiss .
3,407,928 10/1968 Watts, Jr. ..... 206/45.24
3,685,649 8/1972 Diehl ..... 206/45.24
4,272,010 6/1981 Capo .
4,351,473 9/1982 Manizza .
4,531,668 7/1985 Forbes, Jr. .
4,702,368 10/1987 Jones ..... 206/45.24
4,781,289 11/1988 Perkins ..... 206/45.24

*Primary Examiner*—Joseph Man-Fu Moy
*Attorney, Agent, or Firm*—Frank H. Foster

[57] ABSTRACT

A tray type food container having a pair of side panels extending from opposite sides of the lid and folded toward the bottom of the tray. An end of each side panel extends beyond the interposed tray side wall and supports the tray in a generally vertical orientation. A single partial incision or half cut is formed only inward of the tray rim to aid in the controlled fracture of the lid when it is torn from the tray.

10 Claims, 2 Drawing Sheets

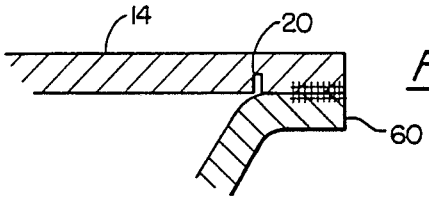
FIG. 4
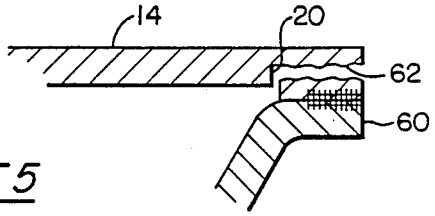
FIG. 5
FIG. 6
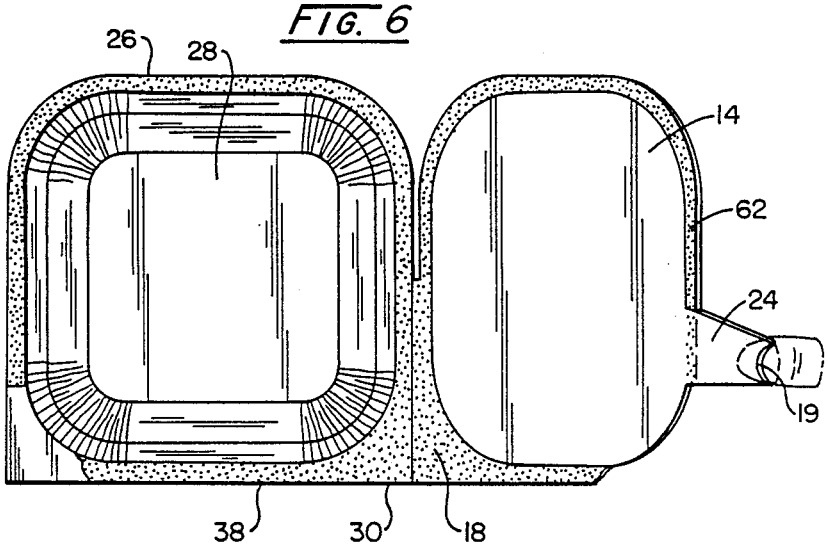

STAND ON END TRAY CONTAINER

TECHNICAL FIELD

This invention relates to the field of paper food containers with removable lids in which the lid is attached to the underlying tray around the rim.

BACKGROUND ART

Paper containers which hold food have been utilized for several years, and have become especially useful since the advent of the microwave oven. The paper container is inexpensive to manufacture, the materials are readily available, the tray itself is almost entirely biodegradable and can usually be used in either a conventional or microwave oven.

The generally low, flat shape of the container and the process in which it is formed make displaying the product's label very difficult. Cans, boxes, and bags all have large side surface areas upon which information is easily printed and which face the consumer when displayed on a grocery store shelf. However, paper tray containers have inclined, small, wrinkled side surfaces which face the consumer when the tray is supported on its bottom panel. Usually trays which are of this general shape have a large top surface area which is not readily visible to a consumer when supported on the shelf of a grocery store. This surface can be easily printed on because it is of higher quality paper, larger surface area and better texture. However, displaying the top surface of the container has not been achieved due to difficulties in supporting the container in an orientation which enables the top to face a shopper.

A method which is presently used to display the large, top surface area is to put the food container in a secondary container such as a paper box. This box can easily be printed on any of its six sides and can also be set up on its edge to display the large top surface area. This secondary container, however, adds time and expense to the consumer who must pay for the extra box and also must remove and dispose of it.

Producers of these containers continue to print on the small, wrinkled side surfaces and display them with these sides facing the consumer or they package the containers in a secondary container for displaying and enhanced printing characteristics.

A second problem which arises from the use of paper is how to securely seal the lid of paper to the tray of paper, yet make it easy enough for the consumer to remove. If the manufacturer very strongly bonds the lid to the rim of the tray to secure a strong seal of the lid to the tray, it becomes difficult for the consumer to open the package to get access to the food. On the other hand, if the strength of the bond is decreased so that the consumer can easily get to the food, the seal may not be strong enough to assure maintenance of a good, airtight seal. This could lead to food spilling out of the container or food spoiling due to contamination.

Previous devices for displaying paper containers are shown in U.S. Pat. No. 1,732,436 to Floto, who uses a container which must first be opened and also must be cut and manipulated before it can be displayed. Another is Weiss, U.S. Pat. No. 2,005,816, which also serves as an open display and also must be erected.

Capo, in U.S. Pat. No. 4,272,010 discloses a paper container, but one which cannot be displayed by resting upon the attaching panels and does not have a lid which is easily removed.

A disadvantage of a food container which is supported by a sheet or panel on its end is that a sheet or panel may tend to bend into a slightly convex contour. The result is that the container may not be suitably stable because it can rock slightly on that convex surface. One advantage of the present invention is that it is preferably constructed so that edges rather than a surface of the tray engages the surface upon which the tray is supported.

One way of dealing with the problem of removing the sealed lid from the tray has been addressed by Forbes, Jr. in U.S. Pat. No. 4,531,668 where Forbes, Jr. forms a double-reverse cut on the lid to make removal easier by the consumer. Another instance of the double-reverse cut is used by Manizza in U.S. Pat. No. 4,351,473. Manizza utilizes the double-reverse cut in the identical fashion as Forbes, Jr. Both of these, however, present manufacturing problems when trying to align the two cuts being made on the lid.

The need exists for a container with a lid section that is easy to remove yet seals tightly, and a means which enables the large, top surface of the container to be displayed, that means providing structural rigidity for the entire container.

BRIEF DISCLOSURE OF INVENTION

The invention is a container of the type comprising a lid removably attached to a tray which has a bottom panel and side walls. The improvement is a pair of side panels which extend from, and preferably are a unitary extension of opposite sides of the lid. The side panels are folded toward the bottom panel of the tray. The ends of the side panel extend beyond the interposed tray side wall. The container is supported on the ends of the side panels and the end of the lid on a support surface with the tray and its attached lid in a generally vertical direction. Preferably the ends of the side panels are formed at an angle less than 90 degrees so that the tray is tilted back slightly from perfectly vertical, but still in a generally vertical orientation. An additional improvement is the provision of a single half cut incision on the tray side of the lid, inwardly of the rim of the tray and cut only partially through the lid. This aids in the controlled fracture and subsequent separation of the portion of the lid lying outside of the bounds of the incision and the main body of the lid which is removed to expose the contents of the tray.

BRIEF DESCRIPTION OF DRAWINGS

FIGS. 4 and 5 are views in side elevation of the manner of attaching the lid to the rim of the tray and of providing the partial cut and illustrating the manner of severing the lid from the tray.

FIG. 6 is a top plan view of the preferred embodiment of the invention illustrated in FIGS. 2 and 3 with the lid removed from the tray.

Figure 1:
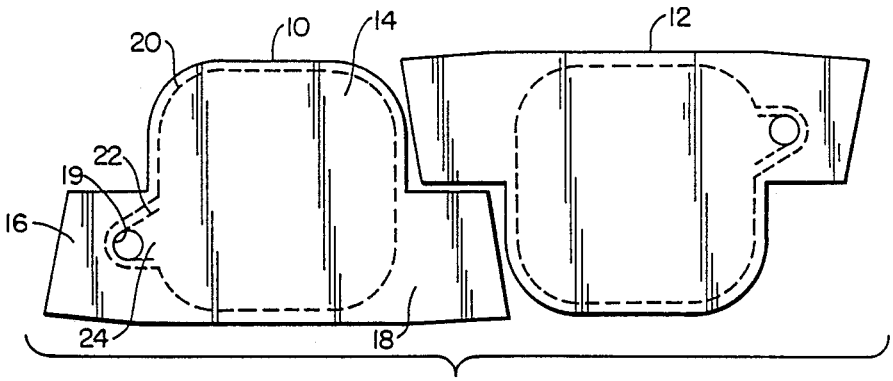
FIG. 1 is a top plan view of two blank lid and side panel bodies illustrating the nesting feature of embodiments of the invention which provides substantial reduction of material waste.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. They are not limited to direct connection but include connection through other circuit elements where such connection is recognized as being equivalent by those skilled in the art.

DETAILED DESCRIPTION

FIG. 1 illustrates the manner of arranging and cutting a pair of blank lid and side panel blanks 10 and 12 with stock paperboard material. These blanks 10 and 12 are identical. The blank 10 has a lid portion 14. A pair of side panels 16 and 18 are attached to and extend from opposite sides of the lid 14. One side panel 16 has a hole 19 cut through the side panel for insertion of a human finger to facilitate removal of the lid from its tray as subsequently described. A half cut incision 20 is cut partially through the lid for aiding in the controlled fracture and separation of the lid portion from the rim of the tray. This half cut incision 20 is cut into the side of the blank, which will be bonded to the rim of the tray, and is positioned inwardly of that rim. However, the half cut also extends around the outside of the hole 20. A second half cut 22 is cut into the opposite side at the hole and extending to the rim so that, upon removal, a tab 24 extends from the removed portion of the lid 14.

FIG. 1 further illustrates that the blanks embodying the present invention, such as the blanks 10 and 12, may be formed in a stock paperboard material in alternatingly opposite orientations so that their respective side panels nest to minimize the waste from the stock material.

Figure 2:
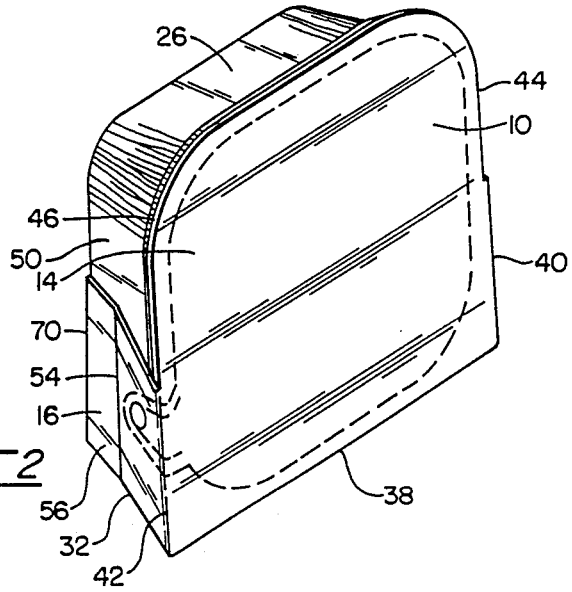
FIG. 2 is a view in perspective of the preferred embodiment of the invention.
Figure 3:
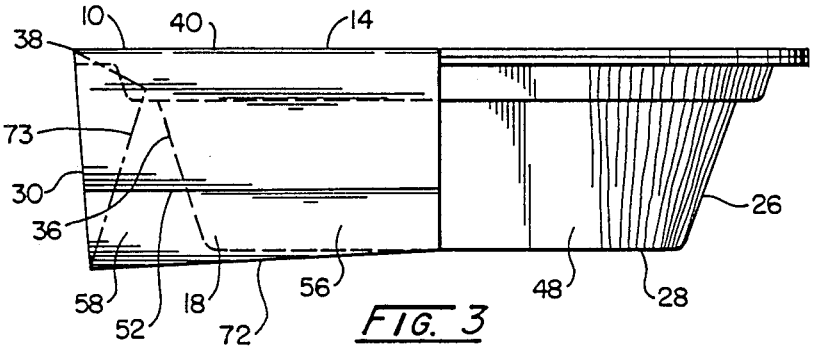
FIG. 3 is a view in side elevation of the preferred embodiment of the invention illustrated in FIG. 2.

FIGS. 2 and 3 illustrate the lid and side panel blank 10, removably bonded to a tray 26 to form a food container. The side panels 16 and 18 are folded toward the bottom panel 28 of the tray 26. The ends 30 and 32 of the side panels 16 and 18 extend beyond the interposed tray side wall 36. These ends 30 and 32, together with the end 38 of the lid 14, support the container on a support surface with the tray and its attached lid in a generally vertical orientation, as illustrated in FIG. 2.

Preferably the side panels 16 and 18 are, as illustrated, formed from a unitary sheet along with the lid 14 and are each folded along respective first and second fold lines 40 and 42 which are generally in alignment with the sides 44 and 46 of the lid 14. It is also preferable that the side panels 16 and 18 are bonded to the tray and most preferable that they are bonded to the opposite side walls 48 and 50 of the tray 26.

This is best accomplished by forming creases 52 and 54 on each respective side panel 18 and 16. These creases 52 and 54 are spaced from the respective fold lines 40 and 42. The terminal portions of the side panels 18 and 16 are bent at the respective creases 52 and 54 so that these terminal portions 56 and 58 are in parallel alignment with the side walls 48 and 50 of the tray. An adhesive material or other bonding means is then used to connect the terminal portions 56 and 58 to the tray side walls 48 and 50 so that bonding is mechanically secure between these parallel surfaces.

It is also preferred that the ends 30 and 32 of the side panels 18 and 16 are formed at an angle of less than 90 degrees with the lid 14 when the side panels are folded. This allows the tray to be supported so that it is tilted back from a perfectly vertical orientation, thus providing additional stability. Additionally, it may be desirable that the side panels 16 and 18 extend beyond the bottom panel 28 of the tray 26 to increase the size of the base which is formed by the ends 30 and 32 of the side panels 18 and 16. This increases the base size and therefore improves the stability of the tray when it is supported upon its end.

Of course, additional panels could be formed to extend from or be attached to the edges of the side panels illustrated forming, for example, flanges on those panels. That, however, is currently deemed undesirable because it requires the use of additional paperboard stock.

The partial cut 20, which extends nearly completely around the underside of the lid 14, is further illustrated in FIGS. 4 and 5. FIG. 5 shows that, when the lid 14 is lifted upwardly for removal from the tray 26, the lid is severed from the rim 60, along a tear line 62. This single, partial incision is easier to manufacture than the conventional double cut because there is only one incision on one side of the lid which thereby eliminates a cutting step. The single incision also requires alignment only with the exterior edge of the lid 14. The conventional double cut requires that both incisions be aligned with each other in proper registration and additionally be aligned with the edge of the lid 14.

In the vicinity of the hole 19 a conventional, oppositely directed, reverse cut is formed by the addition of the partial incision 22. That reverse cut extends from the lid, around the hole, and back to the lid to facilitate severing the lid from the side panel 16 formed with the hole.

The present invention does not utilize an outer sleeve holding the container which is sometimes utilized for packaging. An outer sleeve not only requires a substantial quantity of additional material, but also requires an extra step on the part of the consumer in removing the outer sleeve.

With embodiments of the present invention a grocer can easily display these containers by placing them on the shelf supported upon the ends 30 and 32 of the side panels 18 and 16 with the lid 14 facing the consumer as illustrated in FIG. 2. The surface of the lid 14 provides a surface upon which illustrations, information about the product, and eye catching sales information may be easily printed and viewed by the consumer. It is considerably easier to print upon that surface than upon a side wall of the tray and the surface provides a better quality print. The containers may be placed upon the shelf in rows, one behind another, so that when the front one is removed, the next container will be in place facing the consumer.

FIG. 6 illustrates the lid 14 after having been peeled back for separation from the tray 26. The lid is easily removed by inserting a finger or the thumb of the consumer's hand into the hole 19 to grasp the tab 24. The tab 24 is then simply pulled outwardly and then upwardly from the side panel 16 and away from the tray 26 to sever the lid 14 along the tear line 62. The lid 14 may conveniently be left attached to the side panel 18 so that the two may be disposed of together. Alternatively, the lid may be pulled sideways from the side 48 of the tray 26 to completely remove the lid 14 from the tray 26 by tearing the side panel 18 from the tray 26.

Thus, a container embodying the present invention has the advantages that it makes minimal use of the paperboard material because of the nesting of the lid blanks and the container may be stably supported on its end to expose the printing on the exterior of the lid 14 to the consumer. The container is supported more stably because it rests upon edges or ends of the paperboard material, rather than resting upon the potentially convex or curved surface of a paperboard panel. The extreme terminal edges 70 and 72 of the side panels 16 and 18 may instead be cut at or even above the plane of the bottom panel 28 of the tray. This permits the containers to be stacked in a generally horizontal orientation, for example for convenient packaging in shipping cartons.

As another alternative, instead of cutting the ends of side panels 16 and 18 at cuts 30 and 32, the ends may be cut inwardly from that position, such as along the cut 73 illustrated in phantom in FIG. 3.

While certain preferred embodiments of the present invention have been disclosed in detail, it is to be understood that various modifications may be adopted without departing from the spirit of the invention or scope of the following claims.

I claim:

1. In a container comprising a lid removably attached to a tray having a bottom panel and side walls, the improvement comprising:

a pair of side panels attached to and extending from opposite sides of the lid and folded toward the bottom panel of the tray, an end of each side panel extending beyond an interposed tray side wall for supporting the container on a support surface with the tray and its attached lid in a generally vertical orientation.

2. A container in accordance with claim 1 wherein said folded side panels are bonded to the tray.

3. A container in accordance with claim 2 wherein the side panels are bonded to opposite side walls of the tray.

4. A container in accordance with claim 3 wherein said lid and side panels are a unitary sheet and the side panels are each folded along respective first and second fold lines generally aligned with the sides of the lid.

5. A container in accordance with claim 4 wherein creases are formed on each respective side panel spaced from the lid; the terminal portions of the side panels are bent at said creases in parallel alignment with the side walls of the tray; and these terminal portions are bonded to the tray side walls.

6. A container in accordance with claim 1 or 2 or 3 or 4 or 5 wherein said ends of the folded side panels form an angle of less than 90 degrees with the attached lid for supporting the tray tilted back from perfectly vertical.

7. A container in accordance with claims 1 or 2 or 3 or 4 or 5 wherein hole if formed through one of the side panels for insertion of a finger to facilitate removal of the lid from the tray.

8. A container in accordance with claim 7 wherein a pair of spaced, oppositely directed, partial, scores forming a reverse cut are formed to extend from the lid, around the hole and back to the lid to facilitate severing the lid from the side panel formed with the hole.

9. A container in accordance with claim 8 wherein the side panels extend from the lid beyond the bottom panel of the tray to stabilize the tray when supported on its end.

10. A container in accordance with claims 1 or 2 or 3 or 4 or 5 wherein the side panels extend from the lid beyond the bottom panel of the tray to stabilize the tray when supported on its end.

* * * * *